US007731611B2

(12) United States Patent
Contreras

(10) Patent No.: US 7,731,611 B2
(45) Date of Patent: Jun. 8, 2010

(54) PORTABLE HORSESHOE PLAYING COURT

(76) Inventor: Gabriel Contreras, 701 N. First St., Brawley, CA (US) 92227

( * ) Notice: Subject to any disclaimer, the term of this patent is extended or adjusted under 35 U.S.C. 154(b) by 482 days.

(21) Appl. No.: 11/880,375

(22) Filed: Jul. 19, 2007

(65) Prior Publication Data

US 2009/0020954 A1 Jan. 22, 2009

(51) Int. Cl.
*A63B 67/00* (2006.01)
*G01B 3/00* (2006.01)

(52) U.S. Cl. ..... 473/490; 33/759

(58) Field of Classification Search ..... 473/490; 273/336, 338; D21/706; 33/1 G, 755, 756, 33/759

See application file for complete search history.

(56) References Cited

U.S. PATENT DOCUMENTS 3,039,197 A * 6/1962 Abbott ..... 33/456
3,393,913 A * 7/1968 Safina ..... 273/118 R
3,985,359 A 10/1976 Moore
4,805,916 A 2/1989 Zentner, Jr.
4,880,243 A 11/1989 Raub
4,940,242 A * 7/1990 Tingley ..... 273/287
5,125,669 A 6/1992 Kanda
D338,699 S 8/1993 Bader
5,371,949 A * 12/1994 Delaurier ..... 33/1 G
5,427,383 A * 6/1995 Viens ..... 473/490
5,613,855 A * 3/1997 Thompson et al. ..... 473/438
5,928,095 A * 7/1999 Aldstadt ..... 473/490
5,976,039 A 11/1999 Epel et al.
6,010,416 A * 1/2000 Frederick ..... 473/490
6,241,251 B1 6/2001 Trifonov
6,430,819 B1 * 8/2002 Aldstadt et al. ..... 33/1 G
6,988,964 B2 * 1/2006 Buckfield ..... 473/415
2009/0020954 A1 * 1/2009 Contreras ..... 273/338

* cited by examiner

*Primary Examiner*—Raleigh W. Chiu
(74) *Attorney, Agent, or Firm*—Donn K. Harms

(57) ABSTRACT

A portable horseshoe court demarcation device formed of a plurality of engaged pairs of flexible members such as webbing. The ends of the flexible members once engaged to the ground mark a Horseshoe court. Center sections of one pair of flexible members provide a reference point from which to determine where to place horseshoe stakes, or provide flexible members for marking the installation point for the horseshoe stakes.

12 Claims, 1 Drawing Sheet

PORTABLE HORSESHOE PLAYING COURT

FIELD OF INVENTION

The device herein described and disclosed relates generally to the field of portable game courts. More particularly it relates to an easily transportable horseshoe court which when engaged to the ground defines a complete horseshoe court with foul lines and provides components to accurately place the horseshoe stakes at the correct distance from each other and within the target area.

BACKGROUND

Horseshoes is a game played between two people (or two teams of two people each) which employs four horseshoes and two stakes as targets for the horseshoes. During a conventional horseshoe match, players alternate taking turns tossing their respective horseshoes at the stakes. Modern games of horseshoes generally employ a more stylized U-shaped bar type horseshoe, about twice the size of an actual horseshoe. As the horseshoes are formed of steel, they have a relatively large mass which results in a significant force when tossed forty feet. Since the stakes are constantly hit by a flying horseshoe, it is important that the stakes be firmly planted into the ground.

In order to insure consistency and a regulation match, it is also important that the stakes be placed exactly 40 feet apart in laying out an accurate horseshoe court. In addition to correct positioning of the stakes employed as the horseshoe targets, a tedious process is generally followed to set up the boundaries and foul lines of a regulation horseshoe court.

In such a process, the court makers first measure off 40 feet in a straight line and then drive two 36 inch×1 inch smooth iron rods into the ground at the endpoints of the 40-foot measurement. The stakes are generally driven into the ground either perpendicular to the ground or at a slight angle to the ground, until just 14 inches of the stake remains above ground. In some cases the stakes may be angled slightly such that each stake leans toward the opposite stake. In any case, insuring an accurate 40 foot spacing between the stakes is critical.

Next, a shovel or other digging tool is employed to loosen the top 2 to 4 inches of soil around the stakes. This provides a landing zone for the thrown horseshoes. In a further step in laying out the court, at least one foul line must be positioned at either 27 or 37 ft from each stake. A 27 foot foul line is to be used by children up thru 18 yrs of age, women, and elderly men (70 yrs of age or more). The more widely employed 37 ft. foul line is to be used by all other adult men.

As can be seen, setting up the court with proper distance between the stakes and then designating proper foul lines at proper distances from each other is a tedious process at best. Further, keeping the entire court square when measuring over soil while trying to keep foul lines parallel and within regulation is a daunting process at best, requiring numerous diagonal measurements to insure the court is not actually a trapezoid.

A game of horseshoes is a popular form of entertainment for people at picnics, at the beach and at family outings. However, because of the tediousness of setting up the regulation court, many times the court never gets assembled. As a consequence, picnic participants never get to play the game.

Accordingly, there is an unmet need for a portable horseshoe court demarcation device that is easily deployed to designate a horseshoe court. Such a device should eliminate the tedious and frequently inaccurate measurements required to set the stakes at a proper distance. Such a device should also provide an easy means to mark the foul lines which are measured at a distance from an opposite stake. Finally such a device should remain substantially squared on deployment to insure the court so designated is substantially according to regulation.

Further, in the most preferred mode, such a device should also be compact during transport to allow it to be taken in the trunk of a car. Also, such a device should be easily deployed using a simple tool readily available to users such as a hammer to completely set up the court according to regulation dimensions.

SUMMARY OF THE INVENTION

The device as herein disclosed provides an easily transportable and easily deployable horseshoe court demarcation device. The device features a plurality of flexible members such as rope, which are joined at perpendicular angles to each other to thereby define a horseshoe court area.

A first pair of elongated flexible members are spaced from each other the proper distance to define the landing area on either side of a horseshoe stake being targeted by the players. The first pair of members are held in this spaced parallel engagement by engagement to a second pair of flexible elongated members at overlap points of both pairs. This overlap engagement also serves to hold the second pair of flexible members spaced from each other the proper distance to define foul lines for the horseshoe court.

In the preferred mode of the device, at both ends of each of the first pair of elongated flexible members and the second pair of elongated members, is positioned a means for engagement of a ground spike with the each respective end. As such, during the initial set up of the court, both pairs of flexible members are positioned on the ground in a tensioned engagement between respective ground spikes engaged at each of their ends. During installation, pulling on both ends of each flexible member will cause it to tighten and straighten along its length. At this point, the ground spikes are engaged at the ends of each flexible member and into the ground. The resulting engagement of ground spikes at the distal ends of each such member hold it tensioned and straight. To insure the court is square, a square or other component having two perpendicular sides may be employed as a guide at the intersection of the crossing flexible members.

Also, in an especially preferred mode of the device, a pair of stake placement members are provided. The stake placement members extend away from each other from engagement points substantially at the center of each of the second pair of elongated members. From their engagement to the second elongated members, these stake placement members each extend to a distal end which is employed to determine the exact placement point fore each of the two Horseshoe target stakes into the ground. Once these installation points are determined, and the target stakes installed, the stake placement members may be rotated out of the way substantially adjacent to the respective one of the second pair of flexible elongated members to which they engage. Or, in a particularly preferred mode of the device, the stake placement members may be detached.

Using the stake placement members alleviates the need for measuring tapes to set up the horseshoe court and greatly reduces the time needed for such a set up. Since the stake placement members are centered on the elongated members, and because they are of a length to yield the proper 40-foot distance between the target stakes, no measurements need be taken to ascertain their proper placement. Further, since the foul lines and landing lines are defined by the engaged first pair and second pair of flexible members, no measuring is required by users to ascertain these demarcations either.

The overlap points of the first and second pairs of members are held in engagement with each other using means to fixedly engage the overlapping first and second members. Currently, sewing, or a hog-ring, or swag, or rope ties, are preferred modes for fixed engagement of the crossing members at the overlap points. Particularly preferred is sewing as it yields a particularly strong engagement which is also very flat, thereby allowing the overlapping members to lie flat on the ground surface.

Means to engage the ends of both the first pair of members and second pair of members to the ground are also in a preferred mode provided by an aperture engaged to both ends of all four members. Currently a ring is sewn into engagement with each terminating end of each flexible member which allows a ground stake to be driven therethrough. However, other means for slidable engagement with a ground stake to maintain the flexible members taught are anticipated.

The flexible members making up the two parallel pairs of members are made from easily foldable flexible material such as rope or webbing. Webbing works especially well since it lies flat on the ground and provides a demarcation line that is thin and not likely to affect play. Further, it is easily folded into a small confined storage position for the device and does not easily tangle.

In this respect, before explaining at least one embodiment of the portable horseshoe playing court in detail, it is to be understood that the invention is not limited in its application to the details of construction and to the arrangement of the components set forth in the following description or illustrated in the drawings. The invention is thus capable of other embodiments and of being practiced and carried out in various ways. Also, it is to be understood that the phraseology and terminology employed herein are for the purpose of description and should not be regarded as limiting.

As such, those skilled in the art will appreciate that the conception upon which the disclosed horseshoe court demarcation device and method is based, may readily be utilized as a basis for designing other methods and components for carrying out the several purposes of the present invention. It is important, therefore, that the claims be regarded as including such equivalent construction insofar as they do not depart from the spirit and scope of the present invention.

It is an object of this invention to provide an apparatus to easily define a horseshoe playing court without the need for measurements by the users.

It is a further object of this invention to provide such a horseshoe playing court demarcation device that also is adapted to storage when not in use in a very confined space.

An additional object of this invention is the provision of such a horseshoe court marking device that requires only a hammer and ground stakes to set up and remove.

A further object of this invention is the provision of a horseshoe court demarcation device which accurately provides playing and foul lines and accurately positions horseshoe target stakes, distanced from each other in a regulation fashion.

These together with other objects and advantages which will become subsequently apparent reside in the details of the construction and method as more fully hereinafter described and claimed, reference being had to the accompanying drawings forming a part thereof, wherein like numerals refer to like parts throughout.

BRIEF DESCRIPTION OF THE DRAWING FIGURES

Figure 4:
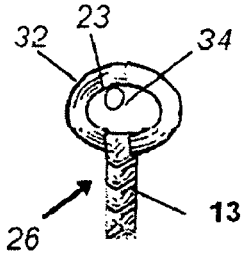

FIG. 4 an enlarged view of a ring used in a preferred mode of providing means to engage a ground stake to the distal ends of both pairs of elongated members and which can be used as a ground position target for placement of the horseshoe stakes when engaged to the distal ends of the stake placement members.

Figure 5:
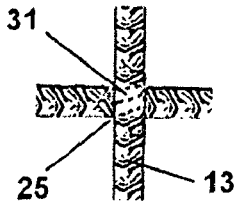

FIG. 5 is a close up view of another mode of the engagement points of the two pairs of parallel flexible members showing sewing of two planar webbing type members.

Figure 6:
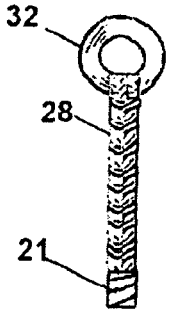

FIG. 6 depicts a removable stake placement member provided to insure accurate distancing of target stakes for the horseshoe without measurements being needed.

Figure 7:
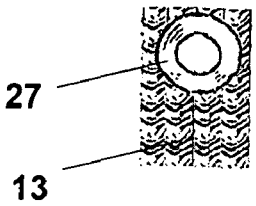

FIG. 7 depicts a web member employing a grommet at the distal end for engagement to a ground spike.

DETAILED DESCRIPTION OF PREFERRED EMBODIMENTS

Referring now to the components in the various drawings shown in FIGS. 1-7, the preferred embodiments of the present invention in current preferred modes are shown and described. The device as herein disclosed provides an easily transportable and easily deployable horseshoe court demarcation device 10. The device 10 features a plurality of flexible members formed of flexible material such as webbing 13 or rope 19, which are joined at perpendicular angles to each other, to thereby define a horseshoe court area.

Figure 1:
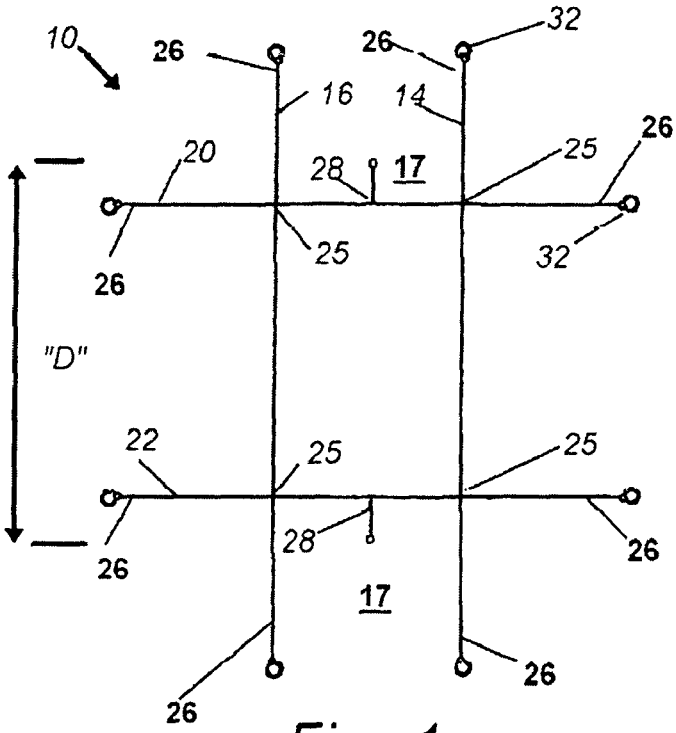
FIG. 1 depicts a top view of the device being employed to lay out a regulation horseshoe court.

As best shown in FIG. 1, in the preferred embodiment of the device 10 there is a first pair of elongated flexible members 12 formed of first member 14 and second member 16. The first member 12 and second member 14 are spaced from each other the proper distance to define the landing area 17 surrounding properly positioned horseshoe stakes 24 which are the targets for horseshoes thrown by the players.

The first pair of members 12 are maintained in a properly spaced and parallel relationship using engagement points 25 to a second pair of flexible elongated members 18 formed of crossing third member 20 and fourth member 22. The engagement points 25 occur at the proper spacing for both pairs of flexible members 12 and 18, to thereby maintain their required spacing to provide their function in the horseshoe court to define properly spaced foul lines.

As noted earlier, the foul lines are different for men and for women and children. The device 10 can be made in a number of modes to accommodate the differing distances of the foul lines designated by the second pair of members 18 and the spaced relationship of elongated members 20 and 22 thereof. In one preferred mode, the engagement points 25 can be provided by hook and loop fabric 21. This will allow for a plurality hook or loop fabric 21 attachment points upon the first pair of members 12, to provide for different spacing of the second pair of members 18, to accommodate different types of courts. Or, a third pair of elongated members (not shown) might be added parallel to the second pair of elongated members 18 at the other of the men or shorter foul line distance.

Engagement to the ground or underlying surface is accomplished by a ground spike (not shown) that is engaged with both ends 26 of each of the first pair of elongated flexible members 12 and second pair of elongated members 18. The ground spike or other means to hold the ends 26 tensioned, such as a weight on the ends, will allow the user to self-straighten each of the flexible members during deployment and thereby insure a squared horseshoe court.

Figure 2:
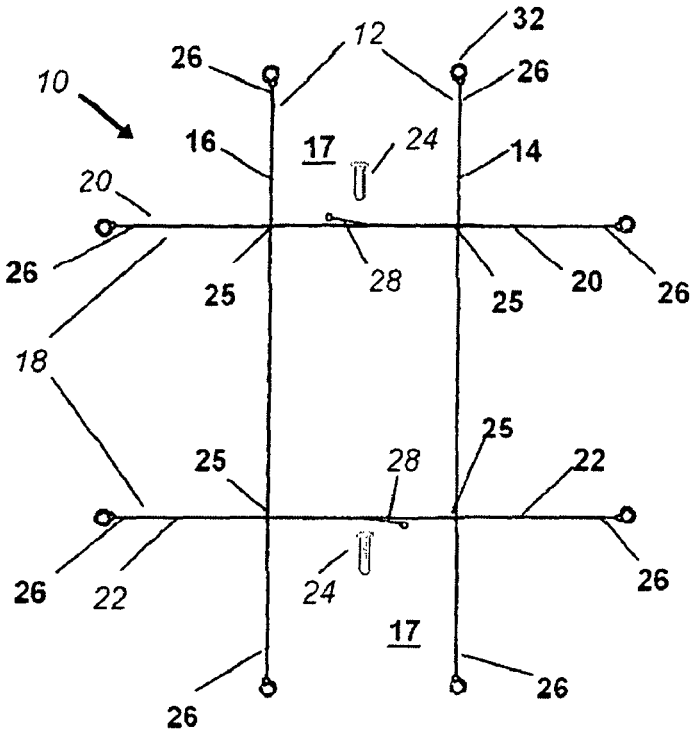
FIG. 2 depicts a top view of the device with the court laid out according to regulations and with the flexible stake placement members folded out of the way.

In the most preferred mode of the device, a pair of stake placement members 28 is provided to make device 10 very easy to use without the need for taking measurements. During installation of the device 10 to its deployed position as shown in FIG. 1, these stake placement members 28 are extended away from each other, from their respective engagement points with a center area of each of the second pair of elongated members 18. From these engagement points the stake placement members 28 extend a length to define a ground target adjacent to the distal ends. This ground target means may be employed by the user to determine the exact placement of the stakes 24 in the ground, to yield the regulation distance "D" between the stakes 24 once the court is installed. Once the respective ground engagement points for each stake 24 is determined, the stake placement members 24 can be removed from engagement to the second pair of members 18 if removably engaged. As shown in FIG. 2, if permanently engaged, they may be rotated out of the way substantially adjacent to the respective one of the second pair of flexible elongated members 18 as shown in FIG. 2.

As noted, provision of these stake placement members 28 alleviates the need for measuring tapes or any measurements at all by the users to set up a regulation horseshoe court. This is because the length between the ground targeting means at the distal ends of the respective stake placement members 28 is sufficient to yield the regulation 40 foot distance "D" between the target stakes 24. In one mode, the ground targeting means is provided by simply marking the ground adjacent to the properly distanced distal ends of the stake placement members 28 when they are moved to a position substantially parallel to both of the first pair of flexible members 12.

In another mode, a grommet 27 or ring 32 or other means for targeting a ground position for the horseshoe stakes 24 may be placed adjacent to the distal ends of the stake placement members 28 as a targeting means. If a ring 32 or similar closed fastener is employed as the targeting means, the stake placement members 28 will work best if their means for attachment to the second pair of members 18 is removable. Currently means for such removable engagement of the stake placement members 28 is provided using cooperating sections of hook and loop fabric 29 engaged to the proximal end of the stake placement member 28, and centered upon the first pair of members 18. This will allow the target stakes 24 to be driven through the ring 32 into the ground with great accuracy. Thereafter, the stake placement member 28 can be disengaged from its engagement to one of the second pair of members 18 and slid from the target stake 24. It may then be reattached and folded out of the way as in FIG. 2. Alternatively, the stake placement members 28 may be elastic in nature so long as the material maintains a proper distance between once it has been stretched and retracted many times.

Also provided in the preferred mode of the device is a means to removably engage the ends 26 of both the first pair of members and second pair of members to a ground spike without damage to the members. Currently a metal or plastic ring 32 having an aperture sized to slidably engage over a ground spike 23 is sewn or otherwise engaged with each end 26 of each flexible member which allows a ground stake 23 to be driven therethrough. However other means to engage the ground members to a ground spike such as grommets 27, fabric loops, or similar means for engagement are anticipated.

Those skilled in the art will realize that other means to allow disengagement of the distal ends of the stake placement members 36 can be provided such as making them slightly elastic but with rings 32, or providing a ground marking projection (not shown) that marks the ground in the proper position allowing removal of the stake placement members 28 before driving the stakes 24.

Whether permanently or removably mounted, the rotational ability of the stake placement members 28 allows them to easily be rotated out of the horseshoe landing area so as not to interfere with play past the foul line defined by the second pair of flexible members 12. Also the stake placement members 28 could be substantially rigid if desired as long as rotationally engaged at their engagement points to the members.

The foul lines and landing are lines for the court, be it for men or women or children, are predetermined by the engaged first pair and second pair of flexible members, at the engagement points 25, eliminating any need for measurements and making the device 10 easy to set up in minutes. Or as noted, the engagement points 25 might also be by hook and loop fabric 29 thereby allowing a plurality of crossing points on the first pair of members 12 for the second pair of members 18 by placement of matting hook and loop fabric 29 at the proper positions along the first set of members 12.

Figure 3:
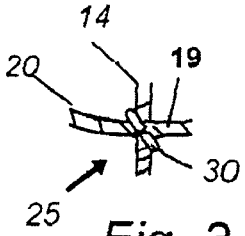
FIG. 3 is close up view of the overlaps of the two pairs of parallel flexible members showing means for fixed engagement at the overlap point.

However, because the device 10 is easily and inexpensively manufactured, a permanent means to engage the respective members in fixed engagement at the engagement points 25 can be provided by sewing with stitching 31 such as in FIG. 5, a swag 30 as in FIG. 3, or hog ring, or a rope tie, or other means for a fixed engagement of the crossing members at the engagement points 25 as would occur to those skilled in the art. While the foul lines would be fixed in one position in this mode, the device 10 because of its inexpensive nature, could be manufactured in different modes for men, women, and children, and coded with indica or employ colored webbing 13 or rope which would designate what type of court the device 10 will provide when deployed.

The horseshoe court demarcation device shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described, may be employed for providing such a device within the spirit of this invention.

As such, while the present invention has been described herein with reference to particular embodiments thereof, a latitude of modifications, various changes and substitutions are intended in the foregoing disclosure, and it will be appreciated that in some instance some features of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

What is claimed is:

1. A portable horseshoe court demarcation apparatus comprising:

a first pair of substantially parallel flexible members each having two ends, said first pair of members having a space defined therebetween;

a second pair of substantially parallel flexible members each having two ends, said second pair of flexible members having a gap defined therebetween;

said second pair of flexible members positioned substantially normal to said first pair of flexible members, and connected to said first pair of flexible members at four engagement points thereto;

means to engage the ends of each of said first pair of flexible members and said second pair of flexible members, to a playing surface such as the ground;

a first landing area defined by the area between said first pair of elongated members and said one of said second pair of flexible members;

a second landing area defined by the area between said first pair of elongated members and said other of said second pair of flexible members;

a first targeting member extending into said first landing area, to a first distal end from an attachment point at a center portion of one of said second pair of flexible members;

a second targeting member extending into said second landing area, to a second distal end from an attachment point at a center portion the other of said second pair of flexible members;

said first distal end and said second distal end proving means to mark the position of installation for a stake into said playing surface, each said stake employed for targeting by thrown horseshoes; and whereby a horseshoe court may be demarcated by engaging said first and second pair of flexible members to the ground and engaging a stake at each said position of installation.

2. The portable horseshoe court demarcation apparatus of claim 1 additionally comprising:

said first targeting member removably engaged to said one of said second pair of flexible members;

said second targeting member removably engaged to said other of said second pair of flexible members;

a first ring positioned at said first distal end;

a second ring positioned at said second distal end;

said first and second rings having apertures therethrough providing said means to mark the position of installation for said stake, whereby stakes may be driven into said ground through said apertures whereafter said first and second targeting members are removable from said second pair of flexible members and slidable from said stakes.

3. The portable horseshoe court demarcation apparatus of claim 2 additionally comprising:

a ring positioned at each of said two ends of each of said first pair of flexible members and at each of said two ends of each of said second pair of flexible members;

each said ring having a passage therethrough;

said passage providing an engagement for a stake providing said means to engage the ends of each of said first pair of flexible members and said second pair of flexible members, to a playing surface such as the ground.

4. The portable horseshoe court demarcation apparatus of claim 3 additionally comprising:

said first pair of flexible members and said second pair of flexible members formed of planar webbing, said webbing providing a low profile to said demarcation apparatus;

four engagement points provided by a stitching of said first pair of flexible members to said second pair of flexible members.

5. The portable horseshoe court demarcation apparatus of claim 2 additionally comprising:

said first pair of flexible members and said second pair of flexible members formed of planar webbing, said webbing providing a low profile to said demarcation apparatus;

four engagement points provided by a stitching of said first pair of flexible members to said second pair of flexible members.

6. The portable horseshoe court demarcation apparatus of claim 1 additionally comprising:

a ring positioned at each of said two ends of each of said first pair of flexible members and at each of said two ends of each of said second pair of flexible members;

each said ring having a passage therethrough;

said passage providing an engagement for a stake providing said means to engage the ends of each of said first pair of flexible members and said second pair of flexible members, to a playing surface such as the ground.

7. The portable horseshoe court demarcation apparatus of claim 6 additionally comprising:

said first pair of flexible members and said second pair of flexible members formed of planar webbing, said webbing providing a low profile to said demarcation apparatus;

four engagement points provided by a stitching of said first pair of flexible members to said second pair of flexible members.

8. The portable horseshoe court demarcation apparatus of claim 1 additionally comprising:

said first pair of flexible members and said second pair of flexible members formed of planar webbing, said webbing providing a low profile to said demarcation apparatus;

four engagement points provided by a stitching of said first pair of flexible members to said second pair of flexible members.

9. The portable horseshoe court demarcation apparatus of claim 1 additionally comprising:

said second pair of flexible members providing means to designate a foul for said horseshoes falling short thereof during a toss thereof.

10. The portable horseshoe court demarcation apparatus of claim 2 additionally comprising:

said second pair of flexible members providing means to designate a foul for said horseshoes falling short thereof during a toss thereof.

11. A portable horseshoe court demarcation apparatus comprising:

a first pair of substantially parallel flexible members each having two ends, said first pair of members having a space defined therebetween;

a second pair of substantially parallel flexible members each having two ends, said second pair of flexible members having a gap defined therebetween;

said second pair of flexible members positioned substantially normal to said first pair of flexible members, and connected to said first pair of flexible members at four engagement points thereto;

means to engage the ends of each of said first pair of flexible members and said second pair of flexible members, to a playing surface such as the ground;

a first landing area defined by the area between said first pair of elongated members and said one of said second pair of flexible members;

a second landing area defined by the area between said first pair of elongated members and said other of said second pair of flexible members;

center sections of said first and second pair of flexible members providing a measuring point, each said measuring point providing a point of reference to measure from and mark the position of installation for a stake into said playing surface, each said stake employed for targeting by thrown horseshoes; and whereby a horseshoe court may be demarcated by engaging said first and second pair of flexible members to the ground and engaging a stake at each said position of installation.

12. The portable horseshoe court demarcation apparatus of claim 11 additionally comprising:

a ring positioned at each of said two ends of each of said first pair of flexible members and at each of said two ends of each of said second pair of flexible members;

each said ring having a passage therethrough; and said passage providing an engagement for a stake providing said means to engage the ends of each of said first pair of flexible members and said second pair of flexible members, to a playing surface such as the ground.

* * * * *